US006234313B1

(12) United States Patent
Slevin

(10) Patent No.: US 6,234,313 B1
(45) Date of Patent: May 22, 2001

(54) CRAFT CADDY

(76) Inventor: Michael James Slevin, P.O. Box 1199, West Yellowstone, MT (US) 59758

( * ) Notice: Subject to any disclaimer, the term of this patent is extended or adjusted under 35 U.S.C. 154(b) by 0 days.

(21) Appl. No.: 09/589,542

(22) Filed: Jun. 8, 2000

(51) Int. Cl.[7] ..... B65D 69/00

(52) U.S. Cl. ..... 206/574; 206/45.2; 206/227; 206/409; 206/459.5

(58) Field of Search ..... 206/574, 575, 206/227, 45.2, 348, 493, 278, 459.5, 391, 394, 409, 561; 223/106–108, 109 R; 242/137.1, 146

(56) References Cited

U.S. PATENT DOCUMENTS 3,321,117 * 5/1967 Hedin ..... 206/227
3,322,310 * 5/1967 Higgs ..... 206/227
4,108,397 * 8/1978 Hauck ..... 206/574
4,186,833 * 2/1980 Homan ..... 206/391
5,881,878 * 3/1999 Faccioli et al. ..... 206/459.5

FOREIGN PATENT DOCUMENTS

0123456 A2 * 1/2000 (EP) ..... 100/100

* cited by examiner

*Primary Examiner*—Luan K. Bui

(57) ABSTRACT

The present invention provides a generally box-shaped case having a removable cover and a base being made of lightweight, yet durable material The removable cover has a sunken-handle located on a top portion and a means for securely attaching the removable cover to the base. The base has an inside portion which is divided into five compartments, with three of the compartments extending on a front to back axis along side of and parallel to each other, and the fourth and fifth compartments extending from side to side along the rear of the base. A removable rod is provided extending from side to side in the interior of the base. The base has a front portion which has three holes therethrough and a measuring device.

4 Claims, 2 Drawing Sheets

CRAFT CADDY

BACKGROUND OF THE INVENTION

The present invention relates to the field of equipment generally useful in a broad variety of crafts and hobbies, and more particularly to the field of sewing, knitting, crocheting and the like, and to a containment and transport caddy therefore.

When sewing, knitting, crocheting and the like are practiced, such activities usually involve and employ a number of tools and a variety of supplies, parts and other materials. Such crafts or hobbies are typically practiced by individuals having no work area available specifically for their craft or hobby. Consequently, these individuals often use the counter-top, kitchen table, dining room table, or other household furniture for that purpose. Additionally, many individuals enjoy practicing their hobby while traveling away from home and the need exists for a convenient, practical means of transporting the materials and parts of their hobby or craft in readily useable manner. Conventional project boxes described to address these problems include many different types. However, none provide for a craft caddy in the manner which is provided for in the present invention.

U.S. Pat. No. 5,287,964, issued Feb. 22, 1994 to Jacquand et al. teaches a packing for photographic web materials and a packing process including a lightproof base adapted for handling by a lift truck, a rigid lightproof case which can be connected to the lightproof base, at least one spindle located in the room delimited by the lightproof base and the lightproof case having a free end adapted to receive rolls of photographic paper.

U.S. Pat. No. 4,887,717, issued Dec. 19, 1989 to Secrest, Jr., teaches a carburetor tune-up kit package which has a box-like configuration with a plastic overwrap, four interconnected flanges at the top, and carburetor tune-up components built into the package.

U.S. Pat. No. 4,630,730, issued Dec. 23, 1986 to Storey teaches a workbox for a knitting project having a plurality of small containers to house individual yarns connected together, each having a loading door and a top aperture that is staggered with its neighbor apertures from which yarn issues, a swivel supporting the box, a cover, and a handle.

U.S. Pat. No. 4,186,833, issued Feb. 5, 1980 to Homan teaches a gift wrapping storage container having ribbon spool storage and dispensing dowels in the cover and a divided major container portion for storage of folded paper in one section and cards and ribbons in a smaller section.

U.S. Pat. No. 4,129,213, issued Dec. 12, 1978 to Fleig teaches a portable craft and hobby kit case-like unit having a base containing a working surface and storage compartments and a cover.

U.S. Pat. No. 4,108,397, issued Aug. 22, 1978 to Hauck teaches a caddy for knitting and crocheting yarn having an upwardly opening generally rectangular receptacle including two pairs of opposite walls, a plurality of side-by-side upwardly opening generally semicylindrical bottom wall portions, a top wall having openings for receiving yarn strands, and a removably securable cover.

U.S. Pat. No. 2,554,531, issued May 29, 1951 to Jones et al. teaches a container for dispensing wire, twine, or the like from coils disposed within a plurality of staggered overlapping compartments within the container.

U.S. Pat. No. 1,858,105, issued May 10, 1932 to Mulrey teaches a sewing chest having a body portion, a deep cover connected to the body portion with hinges, a fixed block accommodating a plurality of cylindrical trunnions, and spindles secured to the trunnions.

While each of these prior art devices and the particular features of each serve their particular purposes, none of them fulfill the need of a means for solving the problems outlined above. None of the art as identified above, either individually or in combination, describes a craft caddy in the manner provided for in the present invention.

SUMMARY OF THE INVENTION

The present invention overcomes all of the problems heretofore mentioned in this particular field of art. The present invention provides a generally box-shaped case having a removable cover and a base being made of lightweight, yet durable material. The removable cover has a sunken handle located on a top portion, base balancing points, and a means for securely attaching the removable cover to the base. The base has an inside portion which is divided into five compartments, with three of the five compartments extending on a front to back axis along side of and parallel to each other, and the fourth and fifth compartments extending from side to side along the rear of the base. A removable rod is provided extending from side to side in the interior of the base. The base has a front portion which has three holes therethrough and a measuring device.

Accordingly, a main object of the present invention is to provide a workbox from which sewing, knitting, crocheting and the like may be practiced and in which the materials and partially completed project may be stored and transported in easily accessible manner.

Another object of the present invention is to provide a means of isolating separately required materials such as thread or yarns from dirt, lint, each other, or the opportunity to be snagged or snarled during the fabrication phase of a project.

These and further objects and advantages of the present invention will become apparent from the following description reference being had to the accompanying drawings wherein a preferred form of the embodiment of the present invention is clearly shown.

DESCRIPTION OF THE PREFERRED EMBODIMENT

Figure 1:
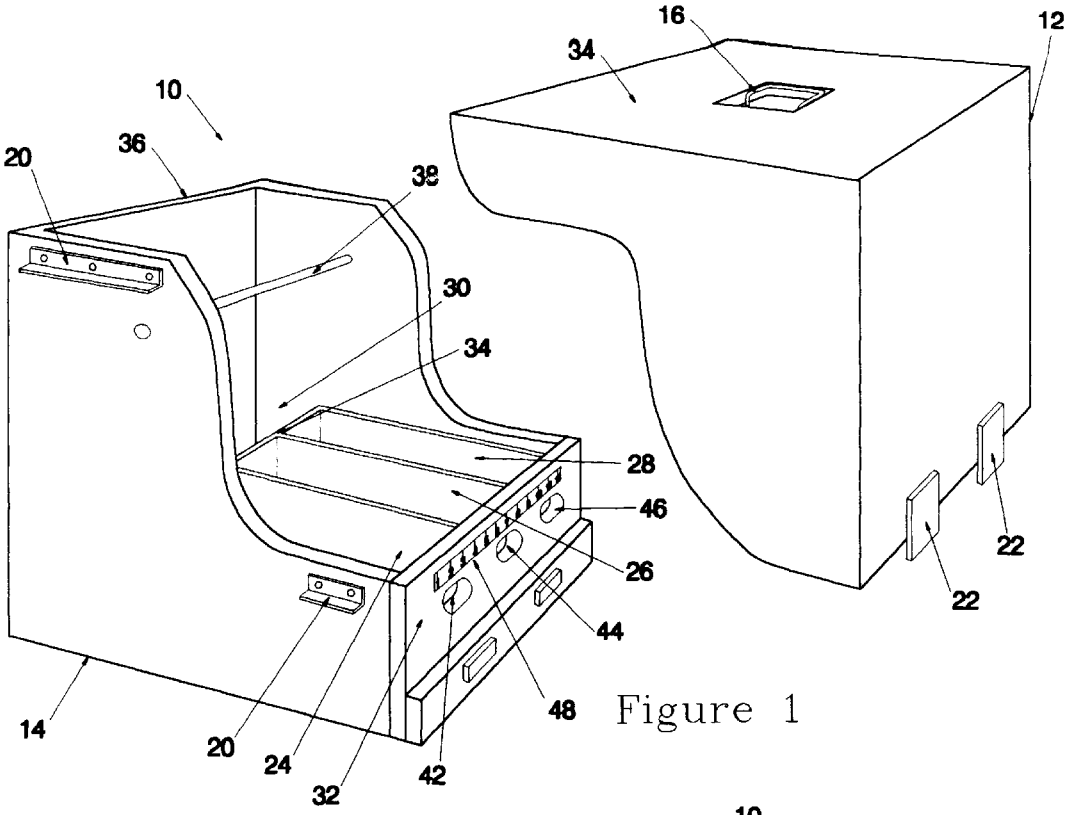
FIG. 1 is a perspective view of the base 14 and the removable cover of the craft caddy of the present invention.

Referring now to the drawings, and more particularly to FIG. 1, which is a perspective view of the craft caddy of the present invention, there is shown a generally box-shaped case 10 having a removable cover 12 and a base 14. The generally box-shaped case 10 is made of lightweight, yet durable material such as plastic.

Figure 2:
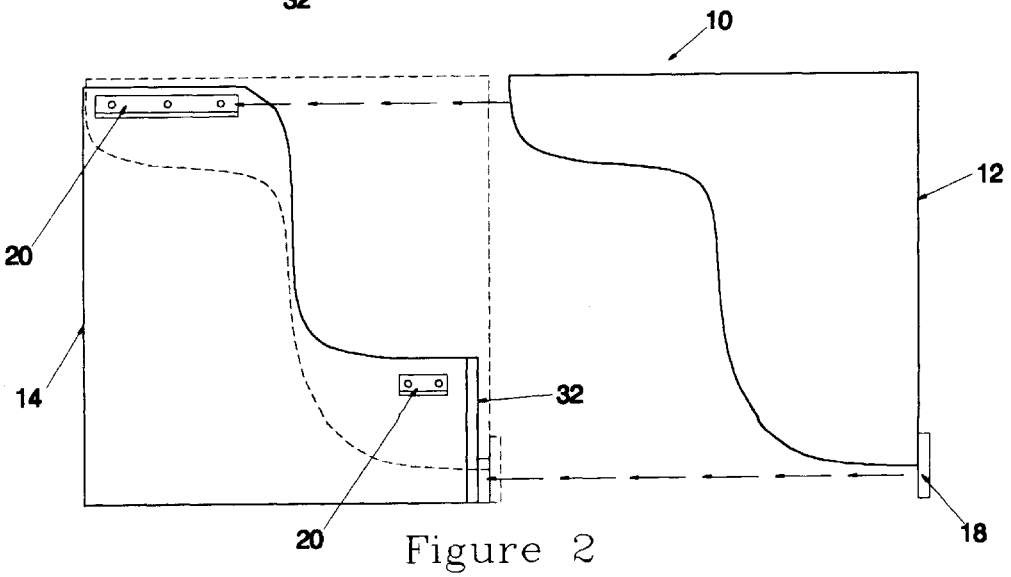
FIG. 2 is a perspective view showing how the removable cover 12 attaches to the base 14 to close the craft caddy of the present invention.
Figure 3:
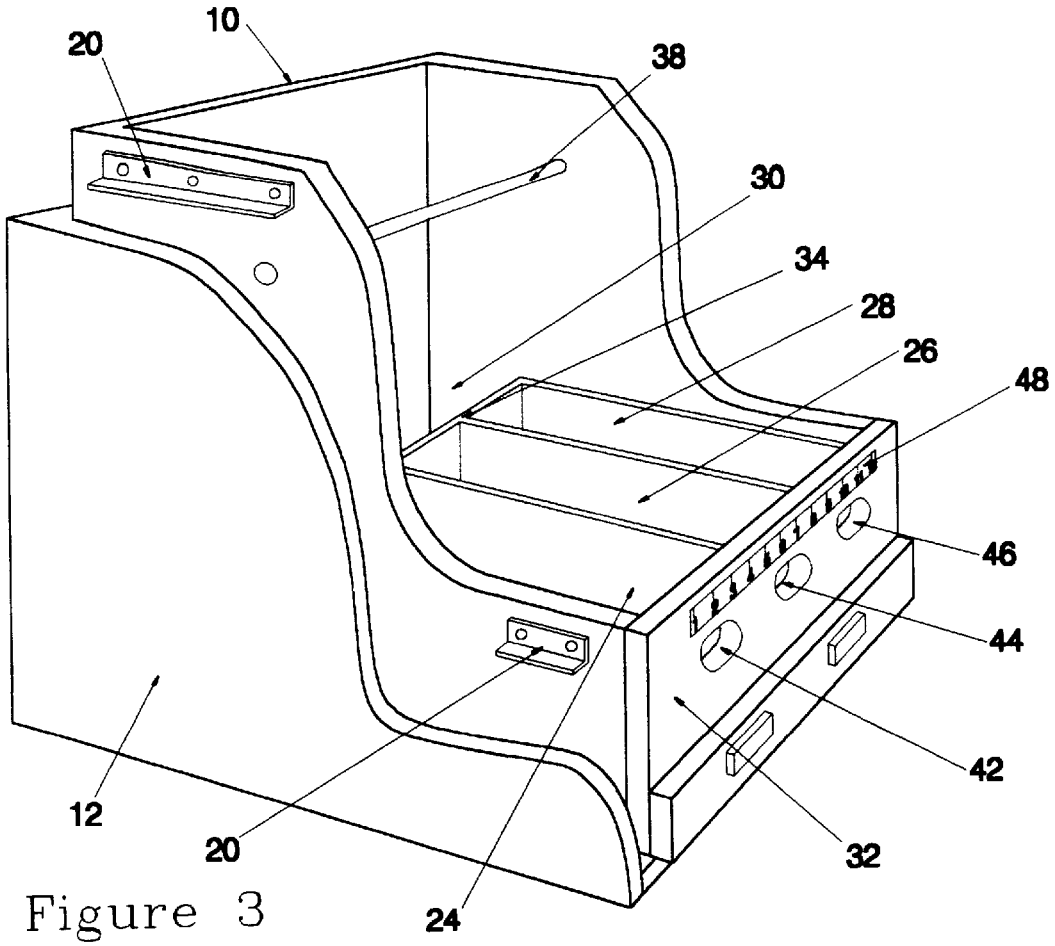
FIG. 3 is a perspective view showing the base 14 sitting within the removable cover 12 of the craft caddy of the present invention such as when the craft caddy is opened for use.

The removable cover 12 has a sunken handle 16 located on a top portion thereof The removable cover 12 has base balancing points which support the base 14 in the removable cover 12 when said removable cover 12 is removed and said base 14 is resting therein in open configuration. The removable cover 12 has a means 18 for securely attaching the removable cover 12 to the base 14. When the removable cover 12 is securely attached to the base 14 by means 18, the interior compartments of the generally box-shaped case 10 are relatively secure from the external environment when in closed configuration. As shown in FIG. 2, one embodiment of the generally box-shaped case provides slides 20 on the removable cover 12 and the base 14 by which the removable cover 12 slides onto the base 14 on the slides 20 and is secured thereto by latches 22. As shown in FIG. 3, when the removable cover 12 has been disconnected from the base 14, the removable cover 12 conveniently slides under the base 14 in such manner as to provide support for the base 14 on the base balancing points while remaining unobtrusive yet handy.

Figure 4:
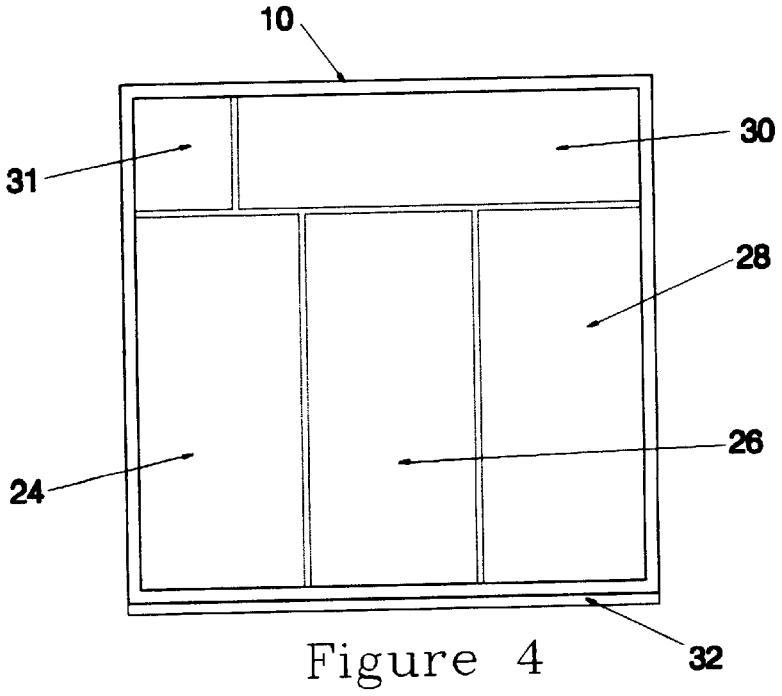
FIG. 4 is a top view of the bottom of the base 14 of the craft caddy of the present invention.

As shown in FIG. 4, the inside bottom portion of the base 14 is divided into five compartments 24, 26, 28, 30, and 31. Viewing the interior of the base 14 from a top perspective, compartments 24, 26 and 28 lie in a front to back axis along side of and parallel to each other and extend from the front 32 of the base 14 to a divider 34 towards the rear 36 of the base 14. Divider 34 creates compartments 30 and 31, which divider 34 extends from side to side along the rear 36 of the base 14. Compartments 24, 26, 28, 30, and 31 are used for readily accessible storage of craft or hobby supplies and parts.

Extending from side to side in the interior of the base and located towards the top of the base 14 is a rod 38, which rod 38 is removable and used for holding yarn or thread or the like while such yarn or thread is being used from a spool or cone. The front portion 32 of the base 14 has provided three holes 42, 44, and 46 therethrough, which holes 42, 44, and 46, said holes 42, 44, and 46 for receiving yarn or thread from spools mounted on rod 38 or from compartments 24, 26, or 28, the yam or thread individually exiting from the interior of the base 14 for separation or combination and use in the practice of the craft or hobby. The front portion 32 of the base 14 has a measuring device 48 provided on the top thereof Various changes and departures may be made to the invention and method without departing from the spirit and scope thereof Accordingly, it is not intended that the invention be limited to that specifically described in the specification or as illustrated in the drawings but only as set forth in the claims. From the drawings and above-description, it is apparent that a craft caddy constructed in accordance with the invention herein provides desirable features and advantages. While the form of the invention herein described constitutes a preferred embodiment of the invention, it is to be understood that the invention herein are capable of further modification, and this application is intended to cover any variations, uses, or adaption of the invention herein, following in general the principles of the invention herein and include such departures from the present disclosure as to come within knowledge or customary practice in the art to which the invention herein pertain, and as may be applied to the essential features hereinbefore set forth and falling within the scope of the invention herein or the limits of the appended claims.

What is claimed and desired to be secured by United States Letters Patent is:

1. A craft caddy, comprising:

a generally box-shaped case, said generally box-shaped case having a removable cover and a base;

said generally box-shaped case being made of lightweight, yet durable material;

said removable cover having a sunken handle, said sunken handle being located on a top portion of said removable cover;

said removable cover having base balancing points;

said removable cover having a means for securely attaching said removable cover to said base;

said base having an inside portion, which inside portion of said base is divided into five compartments, with three of said five compartments extending on a front to back axis along side of and parallel to each other;

said three of said five compartments extend from the front of said base rearwards to a divider located at the rear of said base;

said divider creates a fourth and a fifth of said five compartments, said fourth and said fifth compartments extending from side to side along the rear of said base;

a rod, said rod extending from side to side in the interior of said base;

said rod being removable;

said base having a front portion, with said front portion having three holes therethrough; and, said front portion of said base having a measuring device provided on the top thereof.

2. The craft caddy of claim 1 wherein said said generally box-shaped case further comprises plastic.

3. The craft caddy of claim 1 wherein said generally box-shaped case further comprises slides on said removable cover and said base by which said removable cover slides onto said base on said slides and is secured thereto by latches.

4. The craft caddy of claim 2 wherein said generally box-shaped case further comprises slides on said removable cover and said base by which said removable cover slides onto said base on said slides and is secured thereto by latches.

* * * * *